US005326287A

United States Patent [19]

Hamakita et al.

[11] Patent Number: 5,326,287

[45] Date of Patent: Jul. 5, 1994

[54] CONNECTOR

[75] Inventors: Shozo Hamakita; Osamu Taniuchi; Yutaka Yokoyama; Hajime Kawase, all of Yokkaichi, Japan

[73] Assignee: Sumitomo Wiring Systems, Ltd., Mie, Japan

[21] Appl. No.: 968,486

[22] Filed: Oct. 29, 1992

[30] Foreign Application Priority Data

Oct. 30, 1991 [JP] Japan ..... 3-089252[U]
Oct. 31, 1991 [JP] Japan ..... 3-089748[U]

[51] Int. Cl.[5] ..... H01R 13/519
[52] U.S. Cl. ..... 439/752; 439/595
[58] Field of Search ..... 439/752, 595

[56] References Cited

U.S. PATENT DOCUMENTS 4,867,711 9/1989 Yuasa ..... 439/752
4,867,712 9/1989 Kato et al. .
4,946,399 8/1990 Kawashima ..... 439/752

FOREIGN PATENT DOCUMENTS 3705739 8/1987 Fed. Rep. of Germany .
8912596 2/1991 Fed. Rep. of Germany .

*Primary Examiner*—Eugene F. Desmond
*Attorney, Agent, or Firm*—Sughrue, Mion, Zinn, Macpeak & Seas

[57] ABSTRACT

A connector includes the connector housing and the retainer for securing the terminals in the terminal housings formed in the connector housing. A retainer insertion space enabling insertion of the retainer from either right or left side is formed continuously through and intersecting all of the terminal housings. The retainer insertion space is formed by a channel open through from the front almost to the back of the connector housing, and by a channel open through from the back almost to the front of the connector housing. Locking members formed on the retainer engage and hold the terminals inserted to the terminal housings when the retainer is fully inserted in the connector housing together with the engagement between the recess formed in the terminal and the lance provided in the terminal housing.

6 Claims, 8 Drawing Sheets

CONNECTOR

BACKGROUND OF THE INVENTION

1. Field of the Invention

The present invention relates to a connector with a double locking mechanism for accommodating terminals therein and, more particularly, to a connector having a flexible engaging lance provided in the terminal housings of the terminal housing thereof and a terminal retainer each for holding the terminals.

2. Description of the Prior Art

In conventional connectors, a lance integrally molded with the connector housing is used to lock a terminal crimped to an electrical wire (hereinafter referred to as "terminal") in the terminal housings of the connector housing. The lances are usually not strong enough to hold the terminals securedly, causing the terminals to be incompletely inserted and seated in the connector housing. To avoid such problems, a connector with a double locking mechanism, for an example, Japanese Laid-open Patent Publication No. 64-54678 published Mar. 2, 1985 is proposed. The double locking mechanism consists of a connector housing and a retainer provided independent to the connector housing. In this connector, the retainer is used to secure the terminals in the terminal housings and to prevent an accidental disconnection of the seated terminals. One such connector is shown in FIG. 13.

In this connector with a double locking mechanism, a through-hole 3 is typically provided in the middle of the connector housing 1 so that a retainer 2 can be inserted down into the through-hole 3, as shown in FIG. 13, to secure the terminals.

With this connector, terminals (not shown) crimped to the ends of the electrical wires are inserted to terminal housings 4 formed in the connector housing 1. A lance (not shown) is molded in each of the terminal housings 4 to lock the terminal in the terminal housing 4. The retainer 2 is then inserted in the through-hole 3, and locking tabs 5 formed on the retainer 2 also lock the terminals. The terminals are thus secured by two independent means and are reliably prevented from accidental extraction.

The problem with this connector is its manufacturability. Specifically, the terminal housings 4 are open to both the front and back sides of the connector housing 1. And, the through-hole 3 is opened to both the top and bottom sides of the connector housing 1. Therefore, a pair of dies for molding the front and back sides of the connector housing 1, and a slide die which slides perpendicularly to the front/back dies are required to mold the connector housing 1.

When the slide die is used, the construction of the mold becomes more complex and thus expensive, and molding also takes longer time.

SUMMARY OF THE INVENTION

The object of the present invention is therefore to provide a connector which solves these problems.

The present invention has been developed with a view to substantially solve the above described disadvantages and its primary object is to provide an improved connector with a double locking system.

In order to achieve the aforementioned objective, a connector for accommodating a terminal means having a first engaging means and a second engaging means comprises a retainer means provided with a third engaging means engageable with the second engaging means and a housing means extending in a first direction and having first and second ends opposed to each other and perpendicular to the first direction for accommodating the terminal inserted therein. The housing means is provided with a fourth engaging means engageable with the first engaging means and a guide means for engaging with and guiding the retainer means in a second direction perpendicular to the first direction, whereby when the terminal is properly placed in the housing means and the retainer means is engaged with the guide means, the third engaging means engages with the second engaging means to secure the terminal firmly together with the engagement between the first and fourth engaging means.

BRIEF DESCRIPTION OF THE DRAWINGS

These and other objects and features of the present invention will become clear from the following description taken in conjunction with the preferred embodiments thereof with reference to the accompanying drawings throughout, in which like parts are designated by like reference numerals.

DETAILED DESCRIPTION OF THE PREFERRED EMBODIMENTS

Figure 1:
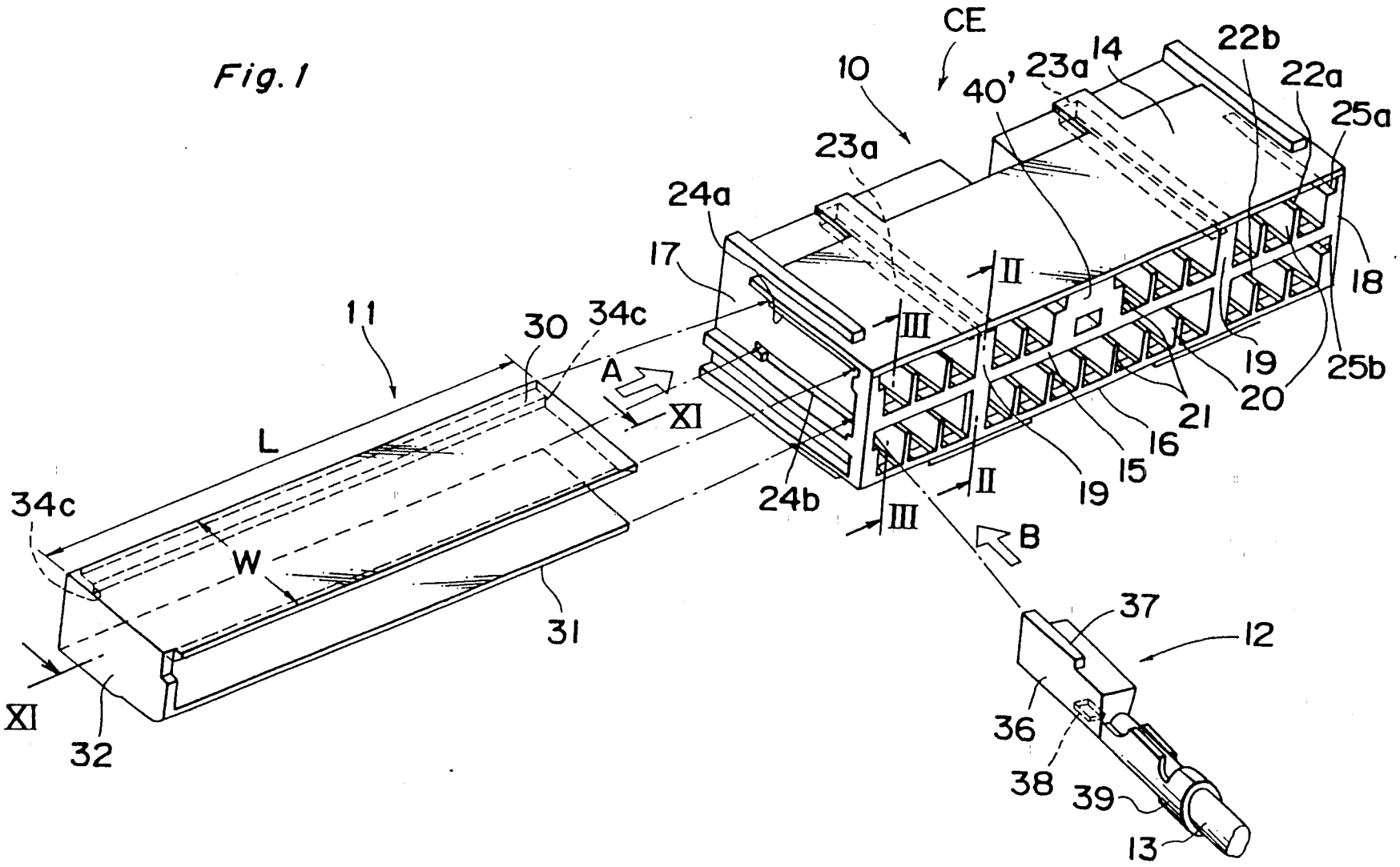
FIG. 1 is a perspective exploded view of a connector according to a preferred embodiment of the present invention.

Referring to FIG. 1, a preferred embodiment of a connector with a double locking system according to the present invention is shown. The connector CE includes a connector housing 10 for accommodating a plurality of terminals 12 and a retainer 11 for securing the terminals 12 in the connector housing 10.

The retainer 11 is integrally molded of an electric insulation material, such as resin, in a generally U-shaped configuration. The retainer 11 has first and second rectangular flat members 30 and 31 opposed to each other, and a linking member 32 connecting one end each of the flat members 30 and 31. The rectangular flat members 30 and 31 have a size defined by a length L and width W, as shown in FIG. 1. These flat members 30 and 31 are inserted into the connector housing 10 for securing the terminals 12 accommodated therein, as will be described in detail later.

The first and second flat members 30 and 31 have first and second engaging edges 34*c* and 35*c* formed on the lower left side edge portion thereof, respectively, as will be described in details later.

The connector housing 10 is integrally molded in a generally rectangular box-like shape by the use of a pair of dies applied from the front and back sides thereof. According to the present invention, a slide die as required in the molding of conventional connectors is not necessary. The connector housing 10 is made of an electrical insulation material such as resin and is formed with a plurality of terminal receiving grooves 21 which are aligned in two horizontal rows, one above the other. Opposite ends of the terminal receiving grooves 21 are opened.

The connector housing 10 has a horizontal top wall 14, a bottom wall 16, a left side wall 17, and a right side wall 18, such that the connector housing 10 is opened at opposed front and back sides.

The connector housing 10 is provided with a row divider 15 between the top and bottom walls 14 and 16 extending between and perpendicular to the right and left side walls 18 and 17. Thus, the row divider 15 divides the inner space of the connector housing 10 in two portions, an upper row space and a lower row space.

The connector housing 10 is further provided with two support pillars 19 integrally formed with the front side edge portions of the top wall 14, row divider 15, and the bottom wall 16, extending perpendicularly thereto.

On the top surface of the row divider 15, a plurality of spacer walls 20 are formed, projecting toward the top wall 14 and having a predetermined clearance from the lower surface of the top wall 14. The spacer walls 20 are extending from the front side to the back side of the connector housing 10. Thus, the upper space is divided into a plurality of elongated cavities, each serving as a terminal receiving groove 21 in the upper row space. Also on the top surface of the bottom wall 16, a plurality of spacer walls 20 are provided in a manner similar to those provided on the row divider 15, forming a plurality of terminal housings 21 in the lower row space. In place of terminal housings 21 at the middle of the row divider 15, a connector key 40' is provided for connecting the mating connector (not shown).

The terminal 12 has a lug 36 for connecting the mating terminal (not shown), a retainer locking member 37 provided on the upper side edge of the lug 36, and a crimping barrel 39 integrally connected with the lug 36 for crimping an electrical wire 13. The lug 36 is provided with a lance engaging recess 38 formed in the bottom thereof for receiving the tapered tip 26*a* (FIG. 3), as will be described in detail later. Thus assembled terminal 12 is inserted the terminal housings 21 of the connector housing 10 in the arrow direction B.

Figure 2:
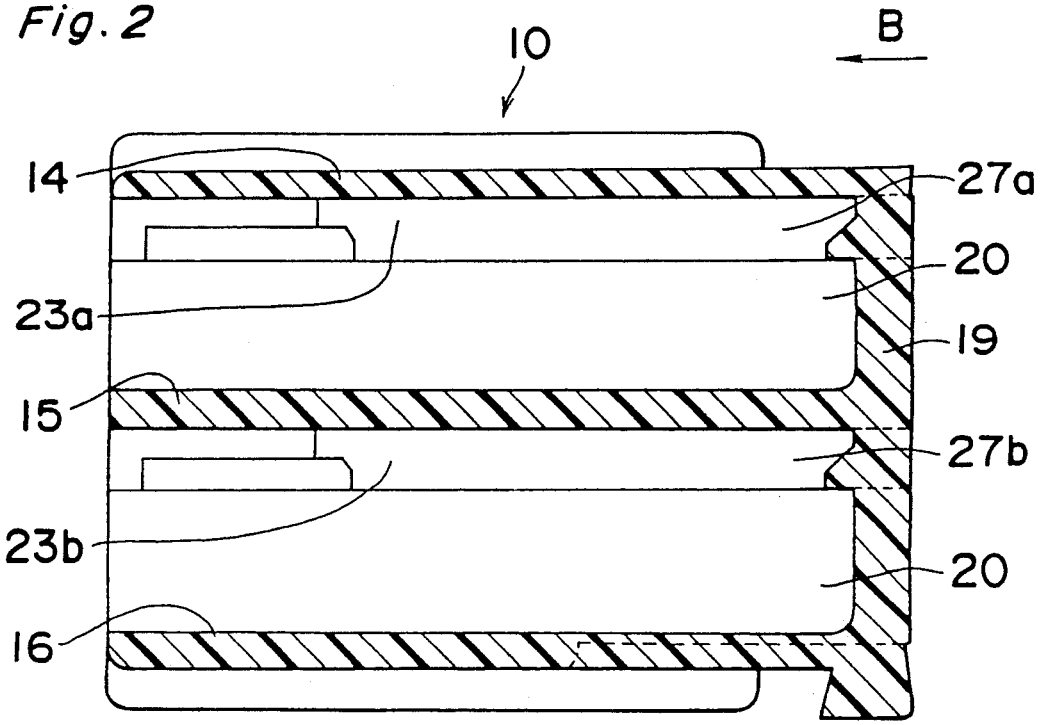
FIG. 2 is a cross-sectional view of a connector housing taken along a line II—II shown in FIG. 1.

Referring to FIG. 2, the internal construction of the connector housing 10 at a portion including the support pillar 19 is described. Above the spacer walls 20 on the row divider 15, an first upper channel 23*a* is formed extending from the back of the support pillar 19 and is opened at the back side of the connector housing 10 so as to receive the first flat member 30 of the retainer 11. It is to be noted that the back of the support pillar 19 where the upper channel 23*a* is formed with a tapered recess for receiving and supporting one edge of the first flat member 30.

Figure 3:
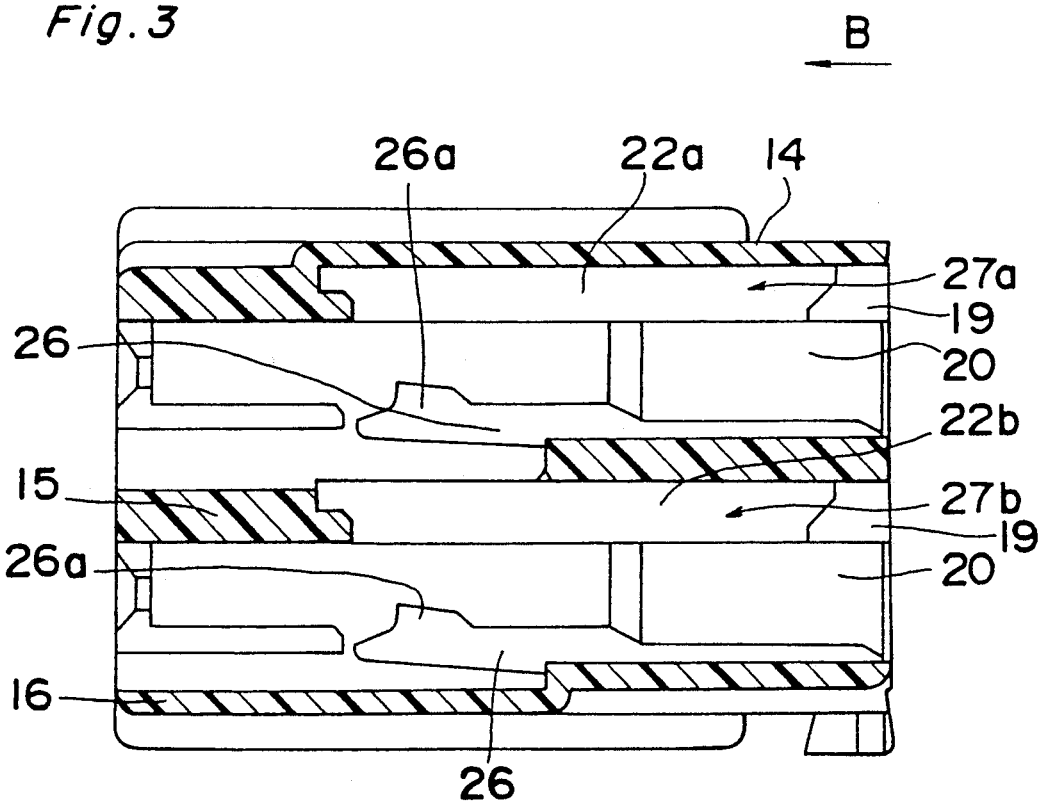
FIG. 3 is a cross-sectional view of the connector housing taken along a line III—III shown in FIG. 1.

Referring to FIG. 3, the cross sectional construction of the connector housing 10 at a portion containing the terminal receiving groove 21 is shown. At the same horizontal position as the first upper channels 23*a*, a second upper channel 22*a* is formed for receiving the first flat member 30. The second upper channel 22*a* has a cross-sectional configuration similar to that of the first upper channel 23*a*. However, the spacer walls 20 extending from the row divider 15 reach the back portion of the top wall 14 so that the channel 22*a* is opened at the front side and is closed at the back side. It is to be noted that the back portion of the top wall 14 is formed with a rectangular recess for receiving and supporting the other edge of the first flat member 30. Under the row divider 15, a second lower channel 22*b* for receiving the second flat member 31 is formed in a manner similar to that of the second upper channel 22*a*.

Referring back to FIG. 1, the left side wall 17 is formed with an upper side channel 24*a* extending horizontally in a manner similar to the upper channels 22*a* and 23*a* and also a lower side channel 24*b* extending horizontally in a manner similar to the lower channels 22*b* and 23*b*. An upper shoulder edge 25*a* is formed horizontally on the inside surface of the right side wall 18 at the same horizontal positions as the upper channels 22*a*, 23*b*, and 24*a*. Furthermore, a lower shoulder edge 25*b* is formed on the inside surface of the right side wall 18 at the same horizontal positions as the lower channels 22*a*, 23*b*, and 24*a*.

When the connector housing 10 is viewed from the left side wall 17 in the direction A, the channels 24*a*, 22*a*, and 23*a* are aligned to define an upper retainer insertion space 27*a* which terminates at upper shoulder edge 25*a*.

Similarly, a lower retainer insertion space 27*b* is defined by the lower channels 24*b*, 22*b*, and 23*b* and lower shoulder edge 25*b*, and is opened at the left side wall 17 and closed at the right side wall 18.

The channels 22*a*, 22*b*, 24*a*, and 24*b*, and shoulder edges 25*a* and 25*b* that are open to the front of the connector housing 10 are formed by extracting a front die (not shown) from the front side of the connector housing 10. The channels 23*a* and 23*b* opened to the back of the connector housing 10 are thus formed by extracting a back die (not shown) from the back side of the connector housing 10. The spaces to which the retainer 11 is inserted can thus be formed using only a single pair of (front/back) dies.

As best shown in FIG. 3, a lance 26 is integrally formed with the floor of each of the terminal housings 21 in the connector housing 10. The lance 26 has a tapered tip 26*a* projecting upward at the free end thereof. The tapered tip 26*a* engages with the lance engaging recess 38 of the terminal 12, when the terminal 12 is placed on the lance 26.

Figure 4:
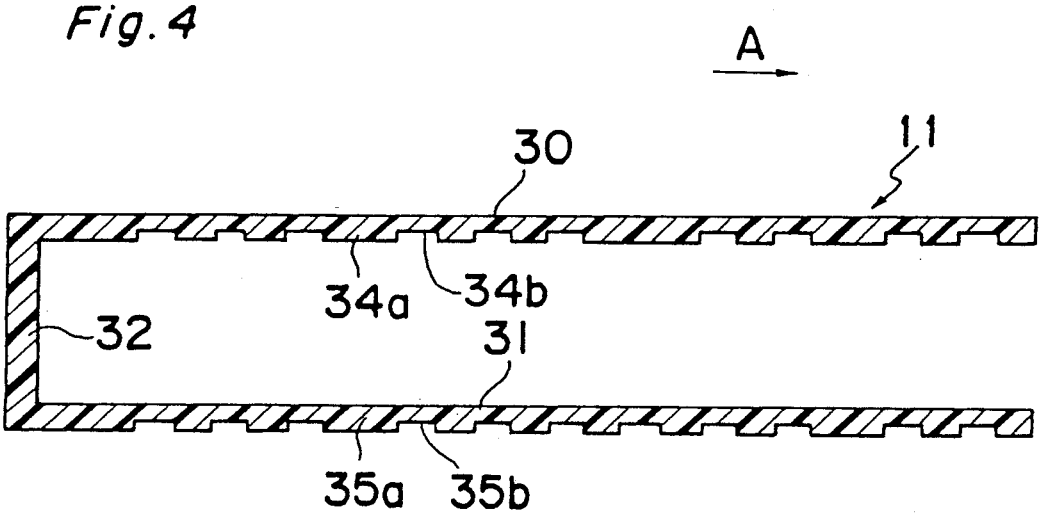
FIG. 4 is a cross-sectional view of a retainer taken along a line IX—IX shown in FIG. 1, FIGS. 5A, 5B and 5C are schematic side views of the terminal securing operation by inserting the retainer into the connector housing shown in FIG. 1.

Referring to FIG. 4, the flat members 30 and 31 of retainer 11, particularly the lower surfaces thereof, are shown. The first flat member 30 is provided with a plurality of terminal locking tabs 34*a* and terminal recess 34*b* formed in the lower surface thereof alternately. These tabs 34*a* and recesses 34*b* are arranged in positions such that a pair of tab 34*a* and recess 34*b* covers a single terminal housings 21, when the retainer 3 is inserted in the connector housing 10.

Figure 6:
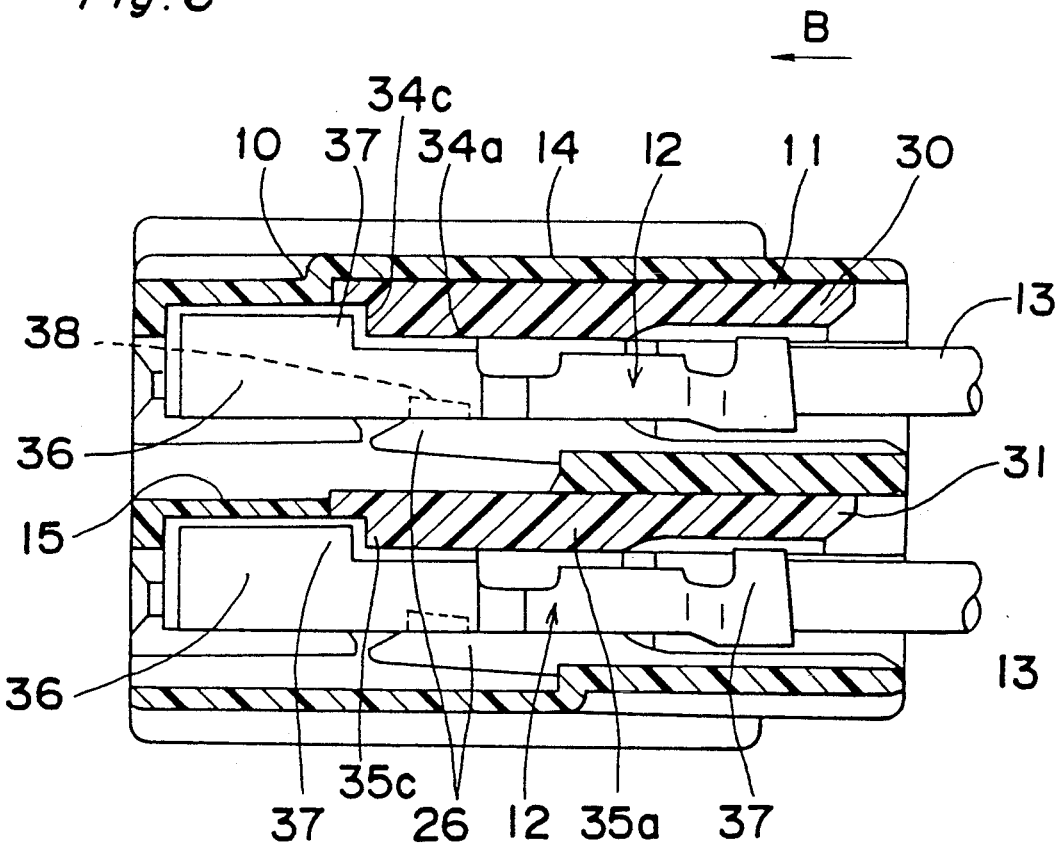
FIG. 6 is a cross sectional view of how the terminals are secured in the terminal housing of the connector shown in FIG. 1.

Referring to FIG. 6, a cross-sectional configurations of the first and second flat members 30 and 31 of the retainer 11 are described. The first flat member 30 has a cross sectional configuration similar to that of upper retainer insertion space 27*a* for fitting therein. The first flat member 30 is further provided with an engaging edge 34*c* formed on the lower left side edge portion thereof, projecting downwardly.

Figure 5A:
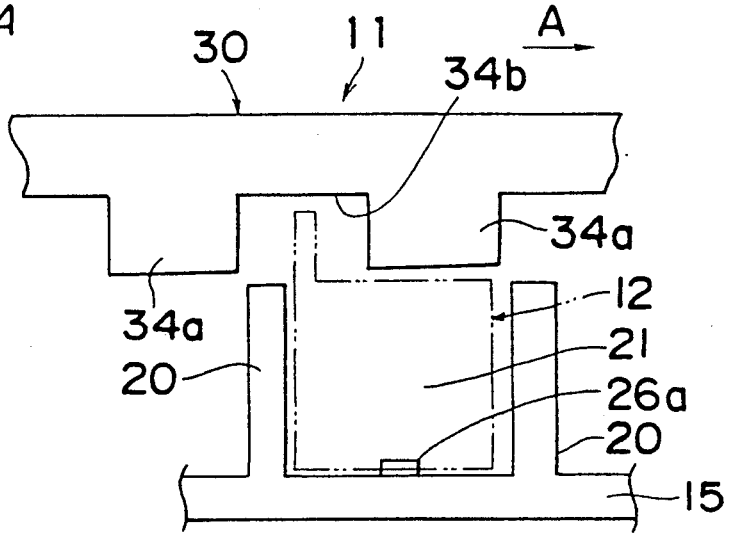
Figure 5B:
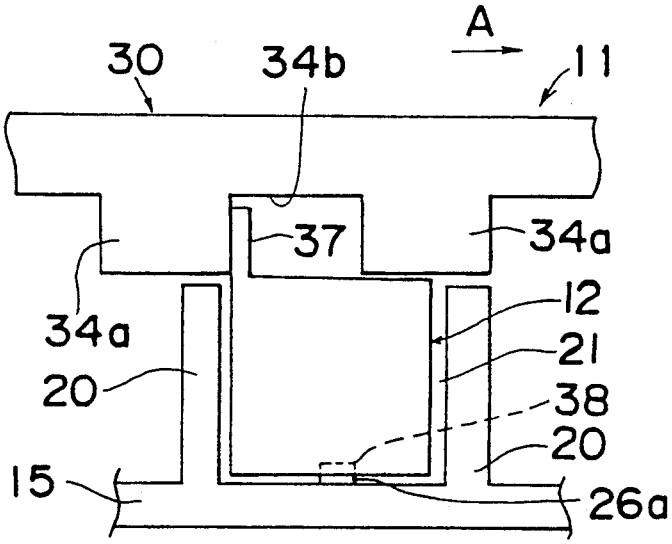
Figure 5C:
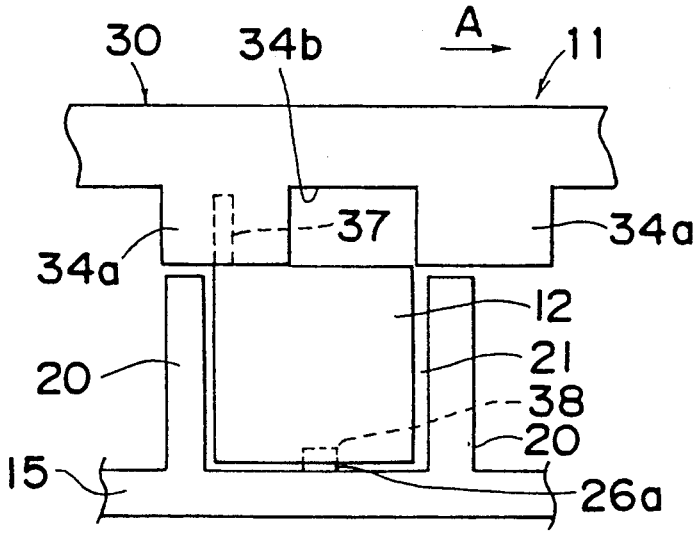

Referring to FIGS. 5A, 5B, and 5C, the steps in which the terminal 12 is secured in the terminal receiving groove 21 by retainer 3 are shown.

As shown in FIG. 5A, at the first step, the connector housing 10 of the retainer 11 is inserted in the connector housing 10 by pressing the linking member 32 in the arrow direction A (also shown in FIG. 1) and is stopped at the position before the full insertion of the retainer 11 in the connector housing 10. In this case, the terminal recess 34*b* is located over the right half portion of the terminal receiving groove 21, so that the locking member 37 of the terminals 12 shown by an imaginary line can be inserted in the terminal cavities 34.

As shown in FIG. 5B, at the second step, the terminal 12 is inserted in each of the terminal housings 21 properly until the lance engaging recess 38 engages with the tapered tip 26*a* of the lance 26. Only the outline configuration of terminal 12 is shown for the sake of brevity.

As shown in FIG. 5C, at the third step, the first flat member 30 is further inserted in the arrow direction A after all of the terminals 12 are properly seated in the terminal housings 21.

When all of the terminals 12 are properly inserted in the terminal receiving grooves 21, the retainer 11 can be fully inserted in the position shown in FIG. 5C. Accordingly, the looking tab 34*a* engages the locking member 37, as best shown in FIG. 6, so that the terminal 12 will not move to the front side even if any accidental pulling force is applied to the terminal 12. The flat member 31 functions substantially the same as the flat member 30.

However, if at least one of the terminals 12 is not properly inserted, the locking member 37 of the improperly inserted terminal 12 contacts the inner wall of the locking tab 34*b* to prevent further insertion of the retainer 11.

As apparent from the above description, terminal 12 is secured in the terminal receiving groove 21 by two engaging means: one is the engagement between the lance engaging recess 38 and tapered tip 26*a* of the lance, and the other is the engagement between locking member 37 and the locking tab 34*a*.

It is needless to say that the terminals 12 can be inserted in the terminal housing first, before insertion of the retainer 11 in the connector housing. Then, after the terminals 12 are properly seated in the terminal housings 21, the retainer 11 will be inserted in the connector housing 10.

The retainer 11 in this embodiment is formed in a U-shaped member made by a pair of flat members for insertion across the terminal housings because the terminal housings are formed in two rows in the connector housing. If only a single row of terminal housings is used, however, a retainer with a single flat member can be used by simply providing a collar on one end to stop at the outside wall of the connector housing. Furthermore, if three, four, or more rows of terminal housings are provided in the connector housing, it is sufficient to provide an identical number of flat members in the retainer with the end member connecting all flat members.

Although the terminal locking tab 34*a* and terminal recess 34*b* are formed in rectangular shapes, in cross section shown in FIG. 4, any other shapes suitable for blocking the locking member 37 can be employed.

As will be known from the above description of the preferred embodiment, a connector according to the present invention can be molded using only a single front/back pair of dies because plural terminal housings are formed in the connector housing open from front to back, and the retainer insertion space, which intersects the top of each terminal housing and is continuous from side to side of the connector housing, is formed by channels that are open from the front to approximately the back of the connector housing, and by a channel that is open from the back to approximately the front of the connector housing.

Thus, the slide die that is required to mold the retainer insertion space in a conventional connector of this type is unnecessary, the molding die can be simplified, production costs can be reduced, and molding cycles can be shortened.

Figure 7:
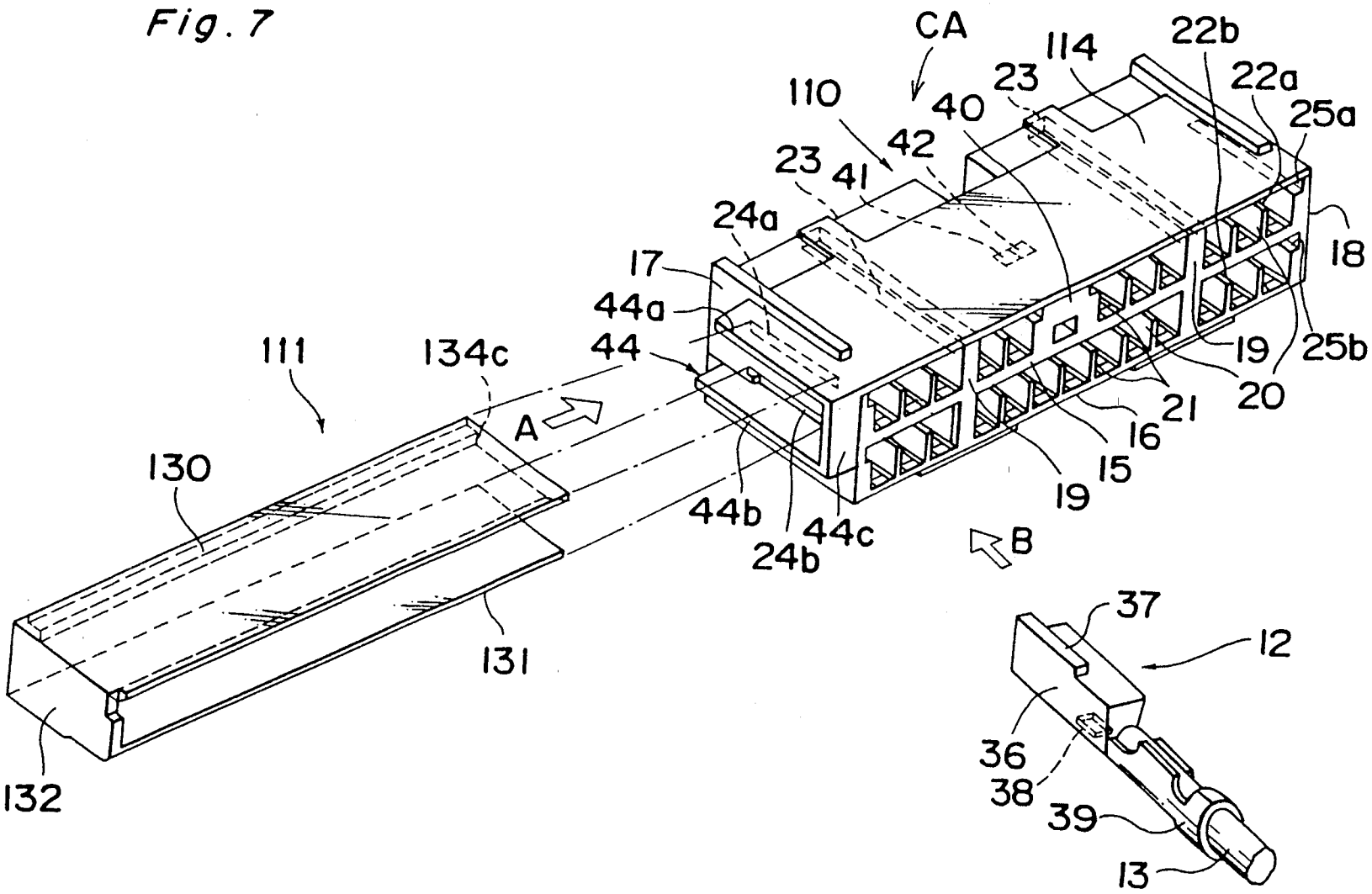
FIG. 7 is a perspective exploded view of a connector according to an alternative embodiment of the present invention.

Referring to FIG. 7, an alternative embodiment of the present invention is described. This alternative connector CA has a construction similar to that of the connector CE shown in FIG. 1. The connector housing 10, connector key 40', and the retainer 11 of the connector CE are replaced with a connector housing 110, a connector key 40, and a retainer 111, respectively. The retainer 111 is formed in a configuration similar to that of the retainer 11 including first and second flat members 130 and 131, a linking member 132 and an engaging edge 134*c*.

Figure 8:
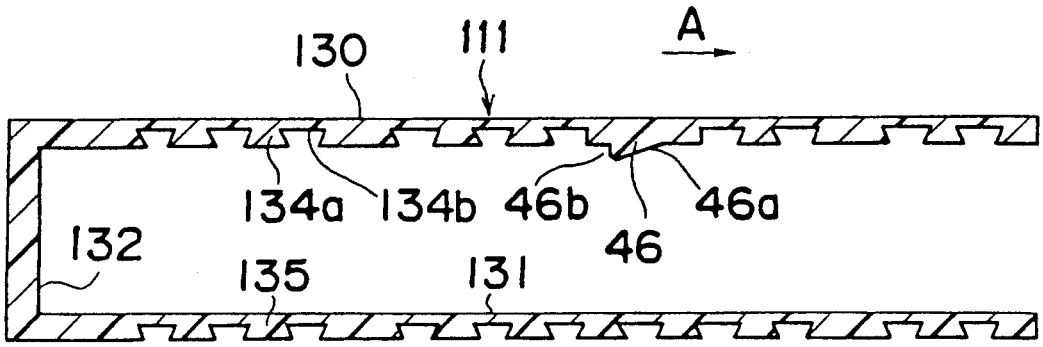
FIG. 8 is a cross sectional view of a retainer of the connector shown in FIG. 7.

Referring to FIG. 8, the retainer 111 is shown. On the lower surface of the first flat member 130, a plurality of terminal locking tabs 134*a* and terminal recess 134*b* are formed. However, the locking tabs 134*a* and terminal recess 134*b* have trapezoidal shapes. The first flat member 130 is provided with a locking projection 46 formed at the middle portion of the lower surface thereof. The locking projection 46 engages with the connector key 40 of the connector housing 110 in two steps, the first step (temporally locking position) is obtained when the retainer 111 is inserted to a position a little before the fully inserted position, the second step (full locking position) is when the retainer 111 is fully inserted.

Figure 9:
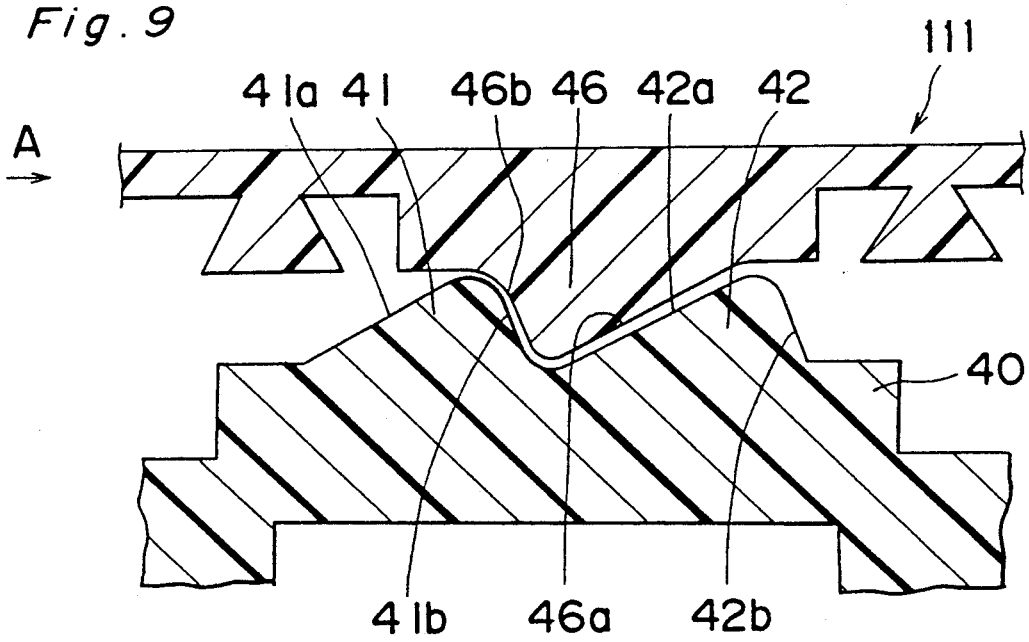
FIG. 9 is a cross sectional view of the locking members of the retainer and the connector housing engaged in a temporary locking position.

Referring to FIG. 9, the engagement between the locking projection 46 of first flat member 130 and the connector key 40 of the connector housing 110 is described herebelow. The locking projection 46 is triangular shaped having a leading (insertion) side which is a gradual right slope 46*a* and the trailing (locking) side which is a steep left slope 46*b*. Hereinafter, all specified directions are relative to the figures.

On the top surface of the connector key 40, a temporary locking tab 41 and main locking tab 42 both triangular shaped are provided side by side such as the temporary locking tab 41 is located on the left side. The temporary locking tab 41 has a non-steep left slope 41*a* and steep right slope 42*b*. The main locking tab 42 also has a non-steep left slope 42*a* and a steep right slope 42*b*.

Therefore, when the retainer 111 is inserted in the connector housing 110, the locking projection 46 first moves over the temporary locking tab 41 along the left non-steep slope 41*a* and rests in the valley between the temporary and main locking tabs 41 and 42, as shown in FIG. 9.

Figure 11:
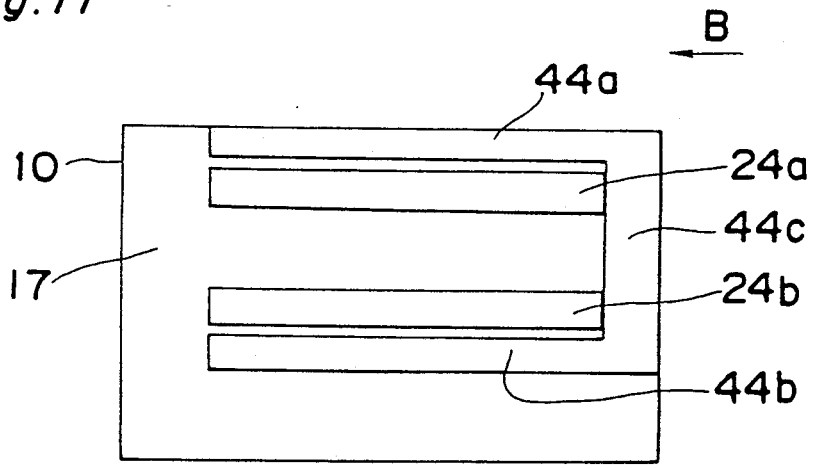
FIG. 11 is a schematic side view of the left side edges of the connector housing shown in FIG. 7.
Figure 12:
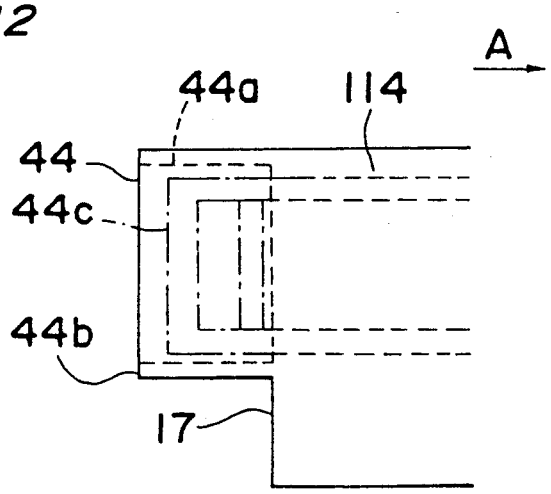
FIG. 12 is an enlarged front view of one end of the connector housing shown in FIG. 7.
Figure 13:
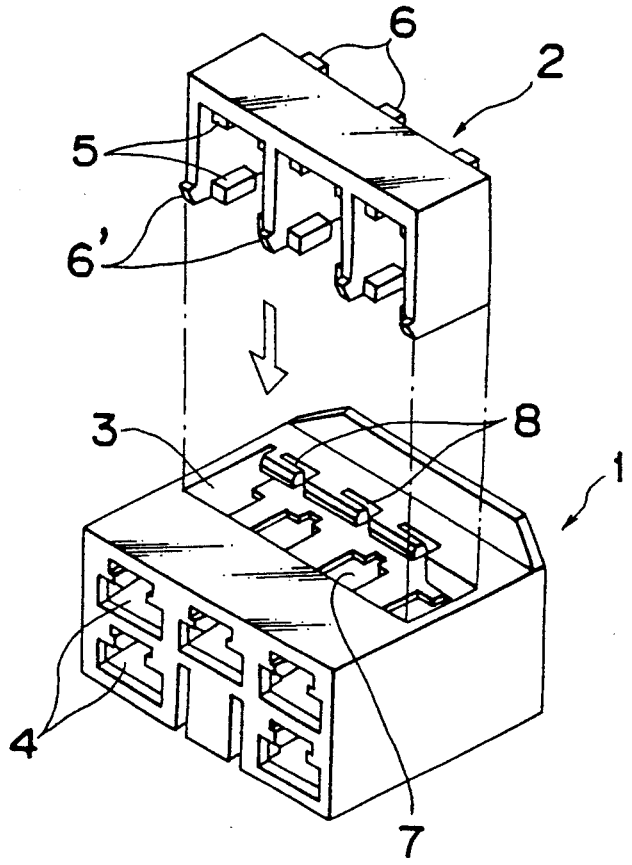
Fig. 13 PRIOR ART
FIG. 13 is a perspective exploded view of a conventional connector with a double locking system.

In addition, when the retainer 111 is in the temporarily locking position, linking member 132 of the retainer 111 projects outside from the left side wall 17, but is surrounded by a rib 44, as shown in FIGS. 7, 11, and 12. The retainer insertion channels 24*a* and 24*b* are provided in the left side wall 17 at a specific gap allowing insertion to the upper and lower retainer spaces 27*a* and 27*b*, respectively. Top, bottom, and front of these channels 24*a* and 24*b* are surrounded by a rib top member 44*a*, a rib bottom member 44*b*, and a rib front member 44*c*, respectively. Thus, the rib 44 prevents a strong outside force from being accidentally applied to the retainer 11.

With the retainer 111 held temporarily in the connector housing 10, the terminals 12 crimped to the ends of the electrical wire 13 are then inserted from the front side to the terminal housings 21. When the terminals 12 are fully inserted to the terminal housings 21, the tapered tip 26*a* of lance 26 engages with the lance engaging recess 38 of the terminal.

After all of the terminals 12 are thus seated in the terminal housings 21, the retainer 111 is further inserted from the temporary locking position all the way into the connector housing 110. This is done by applying pressure to the linking member 132 of the retainer 111 positioned inside the rib 44. Then the connector housing locking projection 46 is caused to ride up over the locking tab 42 and to rest on the right side of the locking tab 42 so that the left steep slope 46*b* rides on the right steep slope 42*b*.

If the terminal 12 is completely seated, the terminal locking tabs 134*a* will smoothly pass the retainer locking members 37 as the retainer 111 is inserted, and will lock the retainer locking members 37 in place as shown in FIG. 6 when the retainer 11 is also seated. At this time the connector housing locking projection 46 of the retainer 11 engages the main locking tab 42 of the connector housing 10. And, the leading ends of the flat members 130 and 131 of the retainer 111 fit into the shoulder edges 25*a* and 25*b* in the right side wall 18.

Figure 10:
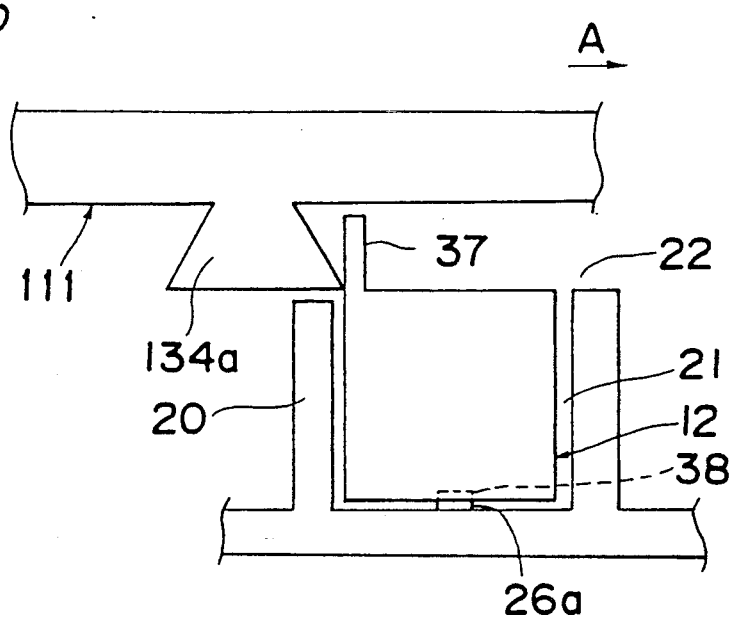
FIG. 10 is a schematic side view of the terminal securing operation by inserting the retainer into the connector housing shown in FIG. 7.

In addition, the retainer locking member 37 of the terminal 12 is not damaged when the terminal locking tab 134*a* contacts the retainer locking member 37 of the incompletely inserted terminal 12 because the leading edge of the dovetail-shaped tab 134*a* contacts the base of the retainer locking member 37, as best shown in FIG. 10.

Thus, when the retainer 111 is in the main locking position, the retainer 111 locks the terminals 12 and is held in place by the connector housing 10.

As will be known from the above description of the preferred embodiments, a connector according to the present invention is constructed to insert a retainer with terminal locking members at a regular interval along the length thereof from either side of the connector housing to a retainer insertion space provided at the top of the terminal housings, which are aligned side by side in a row across the connector housing, so that the terminal locking tabs hold the terminals inserted to the terminal housings in place, it is possible to provide only one connector housing locking tab on the retainer, and a temporary and a main locking tab continuously connected to each other on the connector housing to form a single temporary and main locking mechanism regardless of the number of terminal housings. The overall construction of this connector is therefore simplified, and retainer insertion and removal are easier.

Furthermore, when a rib is provided to surround the part of the retainer exposed to the outside of the connector housing when the retainer is in the temporary locking position, movement of the retainer to the main locking position by an outside force accidentally applied to the retainer can be prevented.

In addition, when the terminal locking tabs of the retainer contact the retainer locking member of a partially inserted terminal, damage to the retainer locking member of the terminal is prevented because the terminal locking tabs are dovetail shaped and contact the base of the retainer locking member.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A connector for accommodating at least one terminal having a first engaging means and a second engaging means, said connector comprising: 'a retainer means provided with a third engaging means engageable with said second engaging means; and a housing means extending in a first direction and having first and second walls, opposed to each other and perpendicular to said first direction, for accommodating said terminal inserted therein, said housing means being provided with a fourth engaging means engageable with said first engaging means and a guide means for engaging with and guiding said retainer means in a second direction perpendicular to said first direction, said housing means further having third and fourth walls, opposed to each other and extending perpendicular to said second direction, said third wall providing an opening aligned with said guide means and said fourth wall being closed, whereby when said terminal is properly placed in said housing means and said retainer means is engaged with said guide means, said third engaging means engages with said second engaging means to secure said terminal firmly together with the engagement between said first and fourth engaging means.

wherein said housing means comprises a plurality of terminal housing means extending in said first direction for accommodating each of a plurality of terminals therein, each of said terminal housing means being in alignment with each other side by side, wherein said guide means comprises:

a first sub guide means formed in said housing means extending in said first direction, having a portion closed at a first side of said guide means, said portion being engageable with one side edge of said retainer means; and a second sub guide means formed in said housing means extending in said first direction, having a further portion closed at said second side of said guide means, said further portion being engageable with the other side edge of said retainer means, whereby when said retainer means is engaged with said guide means, said retainer means is held and guided by said portions, and further wherein said first wall is provided with a third sub guide means formed therein extending in said first direction.

2. A connector as claimed in claim 1, wherein said second wall is provided with a groove means for receiving and securing one edge of said retainer means, formed in said second wall.

3. A connector for accommodating at least one terminal having a first engaging means and a second engaging means, said connector comprising:

a retainer means provided with a third engaging means engageable with said second engaging means;

a housing means extending in a first direction and having first and second walls, opposed to each other and perpendicular to said first direction, for accommodating said terminal inserted therein, said housing means being provided with a fourth engaging means engageable with said first engaging means and a guide means for engaging with and guiding said retainer means in a second direction perpendicular to said first direction, said housing mens further having third and fourth walls, opposed to each other and extending perpendicular to said second direction, said third wall providing an opening aligned with said guide means and said fourth wall being closed, whereby when said terminal is properly placed in said housing means and said retainer means is engaged with said guide means, said third engaging means engages with said second engaging means to secure said terminal firmly together with the engagement between said first and fourth engaging means; and further comprising:

a fifth engaging means (46) provided on said retainer means (111);

a first positioning means provided on said housing means for engaging with said first engaging means and positioning said retainer means at a first position in which said terminal can be inserted into said housing means; and a second positioning means provided on said housing means for engaging with said fifth engaging means and positioning said retainer means at a second position in which said third engaging means can be engaged with said second engaging means.

4. A connector as claimed in claim 3, further comprising a rib means provided on one wall of said housing means projecting in said second direction by a predetermined length for preventing said retainer means located at said first position from a contact with an external object.

5. A connector as claimed in claim 4, wherein said third engaging means is provided at a position in which said third engaging means can contact with said second engaging means when said first engaging means does not engage with said fourth engaging means during the movement of said retainer means from said first position to second position.

6. A connector as claimed in claim 5, wherein said third engaging means has a tapered edge portion for contacting with said second engaging means at a portion proximal to said terminal.

* * * * *